United States Patent [19]

Pennington, Jr.

[11] Patent Number: 4,961,780

[45] Date of Patent: Oct. 9, 1990

[54] BORON-TREATED HARD METAL

[75] Inventor: Donald C. Pennington, Jr., Louisville, Ky.

[73] Assignee: Vermont American Corporation, Louisville, Ky.

[21] Appl. No.: 317,612

[22] Filed: Mar. 6, 1989

Related U.S. Application Data

[63] Continuation-in-part of Ser. No. 211,197, Jun. 29, 1988, which is a continuation-in-part of Ser. No. 167,000, Mar. 11, 1988, abandoned.

[51] Int. Cl.[5] ..... C22C 29/04

[52] U.S. Cl. ..... 75/238; 75/243; 75/244; 75/246

[58] Field of Search ..... 75/238, 243, 244, 246

[56] References Cited

U.S. PATENT DOCUMENTS

| | | | |
|---|---|---|---|
| 2,612,442 | 9/1952 | Goetzel | 75/22 |
| 2,888,355 | 5/1959 | Taylor | 106/43 |
| 3,171,192 | 3/1965 | Ortner et al. | 29/182.2 |
| 3,215,510 | 11/1965 | Kelly | 29/182.8 |
| 3,294,877 | 12/1966 | Hammond | 264/0.5 |
| 3,359,098 | 12/1967 | Teaford | 75/208 |
| 3,368,882 | 2/1968 | Ellis et al. | 29/195 |
| 3,497,368 | 2/1970 | Williams | 106/43 |
| 3,647,576 | 3/1972 | Yamamura et al. | 148/126 |
| 3,690,962 | 9/1972 | Rudy | 148/32 |
| 3,708,355 | 1/1973 | Rudy | 148/32 |
| 3,811,961 | 5/1974 | Weinstein et al. | 148/34 |
| 3,914,473 | 10/1975 | Hale | 427/255 |
| 4,018,631 | 4/1977 | Hale | 427/377 |
| 4,172,162 | 10/1979 | Danzey | 148/427 |
| 4,224,073 | 9/1980 | Sasaki et al. | 106/44 |
| 4,236,926 | 12/1980 | Lindholm | 75/238 |
| 4,277,283 | 7/1981 | Tobioka et al. | 75/238 |
| 4,279,651 | 7/1981 | Fujimori et al. | 75/233 |
| 4,290,807 | 9/1981 | Asai et al. | 75/233 |
| 4,334,928 | 6/1982 | Hara | 75/238 |
| 4,342,595 | 8/1982 | Bourdeau | 75/238 |
| 4,343,651 | 8/1982 | Yazu et al. | 75/238 |
| 4,343,865 | 8/1982 | Graham | 428/552 |
| 4,399,168 | 8/1983 | Kullander et al. | 427/255.7 |
| 4,466,829 | 8/1984 | Nishigaki et al. | 75/240 |
| 4,605,440 | 8/1986 | Halverson et al. | 75/238 |
| 4,692,385 | 9/1987 | Johnson | 428/469 |
| 4,693,989 | 9/1987 | Sane | 501/96 |

FOREIGN PATENT DOCUMENTS 1115908 6/1968 United Kingdom .

OTHER PUBLICATIONS

International Journal of Fracture, vol 15, No. 6, Dec. 1979, pp. 515–536.

Ceramics International 13 (1987) 99–103, Boron as Sintering Additive in Cemented WC–Co (or Ni) Alloys, P. Goeuriot, F. Thevenot, N. Bouaoudja, G. Fantozzi, Elsevier Applied Science Publishers Ltd., England, 1987.

*Primary Examiner*—Stephen J. Lechert, Jr.
*Assistant Examiner*—Nina Bhat
*Attorney, Agent, or Firm*—Middleton & Reutlinger

[57] ABSTRACT

A hard, relatively non-brittle, cemented carbide body is made by sintering pressed grade carbide powders in the presence of a boron-containing material such as boron nitride. During sintering, appreciable quantities of boron migrate or diffuse into the body to become incorporated throughout the microstructure of the carbide resulting in the formation of a third quarternary phase comprised of tungsten, cobalt, boron and carbon.

16 Claims, 9 Drawing Sheets

BORON-TREATED HARD METAL

BACKGROUND OF THE INVENTION

This application is a continuation-in-part of U.S. application Ser. No. 07/211,197, filed Jun. 29, 1988, which is a continuation-in-part of U.S. application Ser. No. 07/167,000 filed Mar. 11, 1988, now abandoned.

The present invention relates to cemented carbide bodies and particularly to cemented carbide bodies that have been treated with boron.

The cutting and drilling industries continue to place increased demands on cutting implements to hold a sharper edge and to last longer. Ordinary cemented carbide-tipped cutting elements consist of a mixture of tungsten carbide (WC) as a hard metal phase and Cobalt (Co) as a binder phase. WC and Co powders are sintered to create a WC/Co cemented carbide body. As is known in the art, many modifications have been made to the simple WC/Co body to enhance its properties for various applications. In general, there is a trade-off between brittleness and hardness. If a harder metal is chosen to cut better and hold a sharper edge, it tends to be more brittle and therefore to suffer brittle failure sooner than a material that is not as hard.

To avoid the problem of increased brittleness while still improving hardness, some people have provided a boron addition as a thin surface coating or layer onto the carbide body. The surface coating or layer may be applied by thermal spraying, physical vapor deposition, chemical vapor deposition, and other known methods. It is also known to diffuse boron into the surface of the cemented carbide body to form a thin, hard layer.

A major problem inherent in all of the attempts to provide a boride coating or layer on WC/Co or other carbide bodies is that, once the thin surface has been worn away, the hardness and other improved features are lost and the tool can no longer be used satisfactorily. If coated saw tips are first brazed onto a saw blade and then sharpened in place, the coating or surface layer may be lost due to the initial sharpening. It would almost certainly be lost on subsequent sharpening. Other problems include the fact that the layer has different thermal expansion and other properties than the substrate and therefore may tend to separate from the substrate during use. Brazing of pieces with layers or coatings is also difficult.

SUMMARY OF THE INVENTION

The present invention provides a cemented carbide which provides a better cutting edge with longer wear characteristics than the prior art without encountering the problems involved with coatings and layers or the problems of increased brittleness encountered in previous attempts.

Surprisingly, the present invention permits the addition of boron to a great depth in the WC/Co or other cemented carbide body without increasing brittleness.

In fact, most of the standard measures, such as hardness, coercive force, and so forth exhibit little change when boron is added in accordance with the present invention, leading one to believe that they must not cause much improvement over the standard WC/Co body. However, the actual field performance of WC/Co or other carbide bodies made according to the present invention has been substantially improved over the performance of conventional WC/Co implements.

It is suspected that the improvement is due to several factors.

Recent analysis of the present invention indicates that the boron causes a third phase to be formed. This third phase appears to act as another binder phase, which includes Cobalt, small amounts of Boron and Carbon, and substantially more Tungsten than appears in the standard binder phase. It is suspected that this third phase causes an improvement primarily by increasing the fracture toughness of the material, thereby making it more difficult for a crack to propagate through the material to cause failure. Corrosion resistance also appears to be improved. It is also thought that the improved microstructure may be able to be sharpened to a finer edger than in the prior art.

Accordingly, it is an object of the present invention to provide an improved boron-enhanced carbide implement suitable for cutting, drilling, grinding, and so forth.

It is a further object of the present invention to provide a method to incorporate boron deep into the structure of a WC/Co or other cemented carbide body.

It is a further object of the present invention to provide an improved cemented carbide body that may be sharpened, resharpened, and reused without losing its original properties.

It is a further object of the present invention to provide a cemented carbide body with improved corrosion resistance.

It is a further object of the present invention to provide a cemented carbide body with improved fracture toughness.

It is a further object of the present invention to provide a cemented carbide body with a carbide phase, a binder phase, and a third phase including a binder material and boron.

It is a further object of the present invention to provide a cemented carbide body with a carbide phase, including a carbide former and carbon, a binder phase, and a third phase including a binder material, boron, and at least 40% by weight of a carbide former.

It is a further object of the present invention to provide a cemented carbide body with a carbide phase, a binder phase, and a third phase which improves toughness without adversely affecting hardness.

These and other improvements will be better understood upon reading the description which follows.

DETAILED DESCRIPTION OF THE PREFERRED EMBODIMENTS

Figure 1:
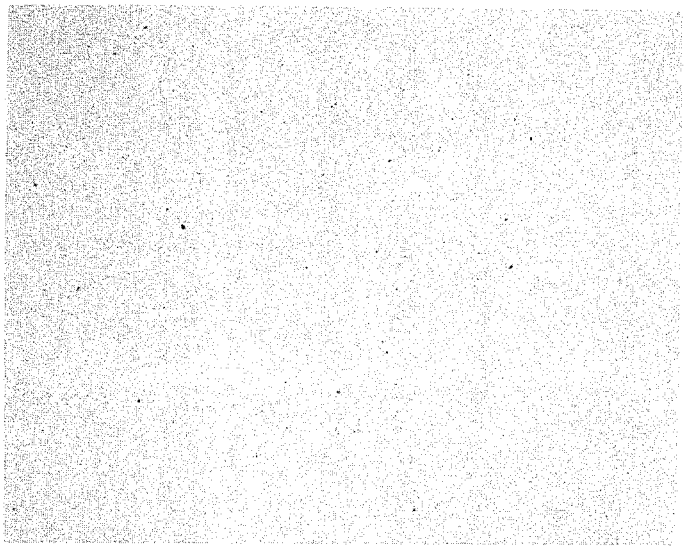
FIG. 1 is a photomicrograph at 200X of a polished section of an untreated (control) extra-fine grain (micrograin) 94.5% WC/5.5% cobalt body which was sintered in a disassociated ammonia atmosphere, the polished section of which has been treated with a standard acid etchant.
Figure 2:
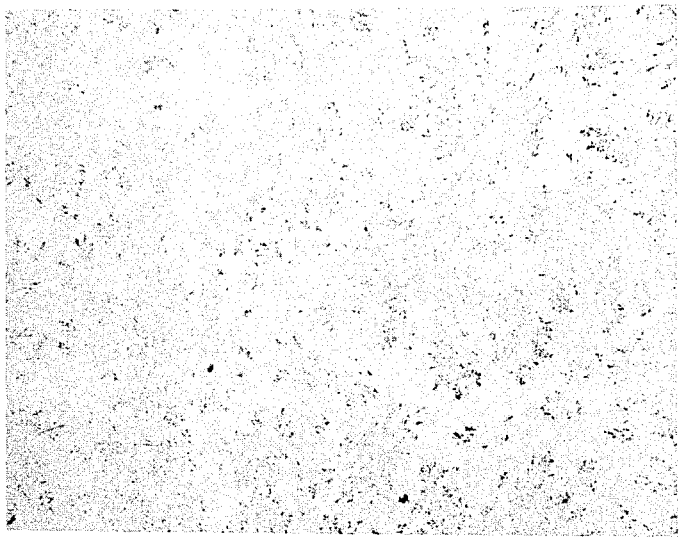
FIG. 2 is a photomicrograph at 100X of an extra-fine grain 94.5% WC/5.5% cobalt body made according to the present invention, where the body was sintered in a disassociated ammonia atmosphere surrounded by sintering sand containing 2.5% by weight of boron nitride (BN), the polished section of which has been treated with an acid etchant.
Figure 3:
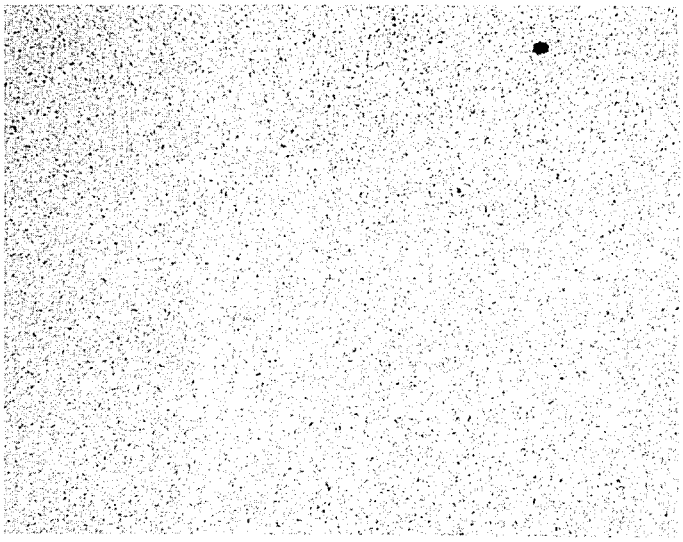
FIG. 3 is a photomicrograph at 200X of a medium grain untreated sample with 87% WC/13% Co which was sintered in a disassociated ammonia atmosphere, the polished section of which has been treated with an acid etchant.
Figure 4:
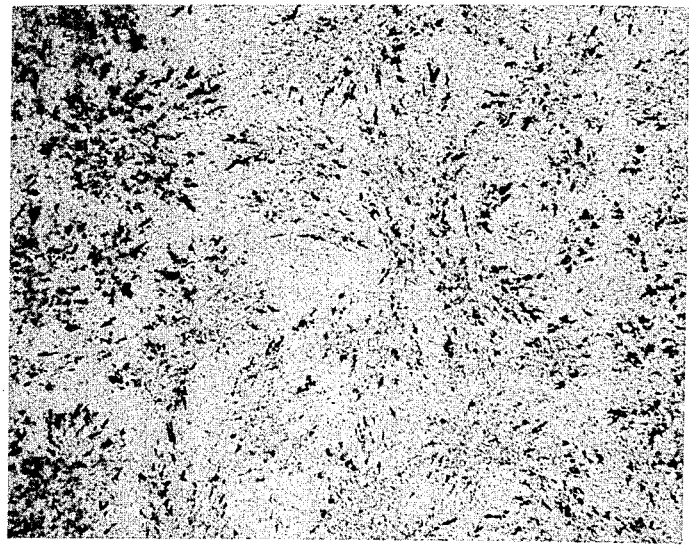
FIG. 4 is a photomicrograph at 100X of a medium grain sample with 87% WC/13% Co which was sintered in a disassociated ammonia atmosphere surrounded by sintering sand containing 2.5% by weight of boron nitride, the polished section of which has been treated with an acid etchant.
Figure 5:
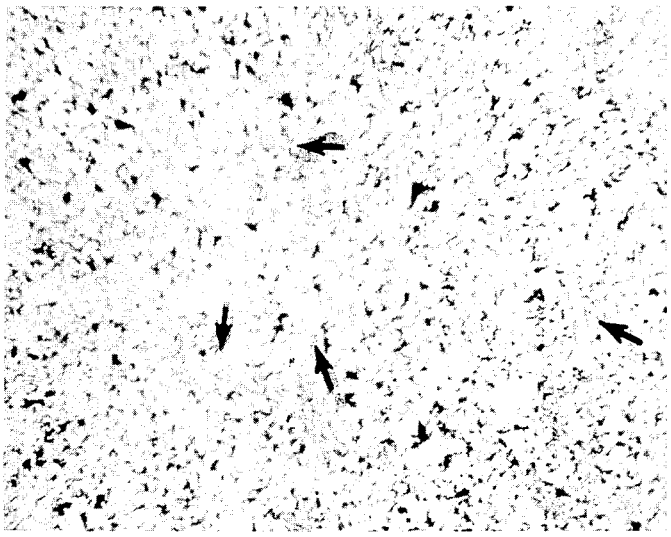
FIG. 5 is a photomicrograph at 1250X of a medium grain sample with 87% WC/13% Co which was sintered in a disassociated ammonia atmosphere surrounded by sintering sand containing 0.5% boron nitride, the polished section of which has been treated with an acid etchant.

The cemented carbide bodies of the present invention are made in accordance with the general teachings of the art in many respects. Generally, cemented carbide bodies are made according to processes in which powders of a carbide material, for example tungsten carbide (WC), and a binder material, for example cobalt (Co), are milled to carefully controlled composition and particle sizes (called "grades") and then dried, for example by spray-drying. The dried grade carbide/binder (for example WC/Co) powder is then pressed in the presence of a lubricant to a selected shape.

If sintering is to be done in a continuous stoking furnace, the shapes are put into graphite boats which have been filled with $Al_2O_3$ grains or other sintering sand. The shapes are surrounded by the sand and are usually put into the boat in layers. First a layer of sand on the surface of the graphite boat, then a layer of the shapes, then more sand, then another layer of shapes, and so forth, until several layers are positioned in the graphite boat. The sand prevents the pieces from sintering together or chipping and serves as an insulator as the boat moves through the furnace into different temperature zones to facilitate liquid phase sintering. In some embodiments of the present invention, a boron-containing powder is mixed into the sand before the shapes are immersed in the sand.

I have used boron nitride, boron powder, boron carbide, and boron oxide as boron-containing powders and believe that other boron-containing powders would also work. When boron nitride (BN) is used as an additive to the sintering sand, which is my preference, a boron nitride product available from Standard Oil Engineered Materials Company, Semiconductor Products Division, 2050 Cory Road, Special Fibers Building, Sanborn, N.Y. 14132 U.S., and sold under the trademark COMBAT®, Boron Nitride Powder CAS number 10043-11-5 has been found to be satisfactory. This is a BN powder having a screen size specification of minus 325 mesh. The concentrations of BN used herein are for this size of powder. Basic chemical and physical principles suggest that if powders of different particle size and therefore different surface areas are used, the concentrations should be adjusted to provide the same effective surface area. Alternative boron-containing materials which should work in the present invention are: $AlB_2$, $AlB_{12}$, CrB, $CrB_2$, $Cr_3B_5$, MoB, $NbB_6$, $NbB_2$, $B_3Si$, $B_4Si$, $B_6Si$, TaB, $TaB_2$, $TiB_2$, WB, $W_2B_5$, $W_2B$, $VB_2$, and $ZrB_2$. Since it is probable that the transport of boron into the cemented carbide is by gas, other sources of boron could be boron-containing organometallics which have relatively low vaporization temperatures, such as $B_3N_3H_6$, $B_{10}H_{14}$, $B_2H_7N$, $B_{10}H_{10}C_2H_2$, $B(OCH_3)_3$, $C_6H_5BCl_2$, $C_5H_5NBH_3$, $B(C_2H_5)_3$, and so forth. Also, other inorganic compounds such as CoB, FeB, MnB, NiB and combinations of boron with the halogens hold promise of successful use, but we have not tried them.

Then, the graphite boats containing sand and shapes pass into the sintering furnace or furnaces, are heated or pre-sintered to drive off the lubricant, and are then heated to the sintering temperature.

If sintering is to be done in a vacuum furnace, the shapes are put onto trays. In order to prevent the shapes from sticking to the trays and to prevent transfer of carbon between the graphite tray and the shape, some type of paint or coating is usually applied to the tray before putting on the shapes. The coating is then dried, preferably in a vacuum drying oven. In the present invention, some form of boron is added to the paint or coating Moderately successful to completely successful tests have been conducted with paint made by mixing boron nitride powder with water and/or alcohol to a paint consistency and simply painting it on the tray. In those tests, the boron entered the shape but not as homogeneously as with the sand. It is thought that a more even distribution of boron would be obtained if the whole shape were painted Other forms of boron-containing powders and other solvents or vehicles likely could be used. Then the tray is inserted into the furnace, is raised to a pre-sintering temperature to drive off the lubricant, and is then raised to a sintering temperature.

Re-sintering of already-sintered bodies may also be conducted in the presence of the boron-containing sand or paint, and the boron will disperse deeply into the body in the same manner. Of course, in this case, pre-sintering is not necessary, because there is no lubricant to drive off.

When the shapes are sintered in the boron-doped sand or paint, some form of boron diffuses or migrates into the shape or body and is dispersed fairly homogeneously for a depth of at least 0.125 inches into the microstructure of the sintered body. Preliminary tests of some thicker bodies, 0.5 inches in thickness, indicate that some gradient of boron is present, with concentrations being greater toward the surface than toward the center. It is believed that, by controlling the amount of boron-containing material in the environment and by controlling the time and temperature of the sintering process, or even re-sintering, it is possible to create a body with a relatively homogeneous dispersion of boron or a variety of desired gradients. Also, it appears possible to re-sinter a body treated according to the present invention—in a controlled atmosphere with no boron-containing material present during such re-sintering—to achieve the desired gradient or homogeneity. However, in no case when the present invention is followed is a surface layer or coating formed. The surface layers formed in the various known coating processes are on the order of 0.001 inches thick, so there is a difference of at least two orders of magnitude between the thickness of a coating and the depth of substantially homogeneous boron dispersion in the present invention.

Surprisingly, the characteristics of the resulting sintered body do not appear to change very much relative to those of identical sintered bodies which are sintered without the presence of boron. Hardness, transverse rupture strength, coercive force, and so forth, are essentially the same. Fracture toughness improves over its value in an otherwise identical body without boron. Resistance to corrosion also appears to improve. And, as test results which will be described below indicate, saw blades with tips made in accordance with the present invention operate markedly better than their counterparts without boron.

In viewing the microstructure of carbide bodies made in accordance with the present invention, several features are of interest:

First, the presence of the boron seems to remove free carbon. When a batch of bodies previously sintered without boron is re-sintered in accordance with the present invention, porosity due to free carbon is greatly reduced or eliminated.

Second, when bodies which have been sintered in accordance with the present invention are etched with Murakami's reagent, they exhibit a rapid etch phase, which etches in a manner similar to a defect known as "eta phase", but which is much finer than a similar "eta phase" configuration and is generally found in swirls or feathers homogeneously throughout the body. Also unlike bodies with "eta phase", the bodies of the present invention do not show an increase in brittleness over bodies without the rapid etch phase. An analysis of the carbide bodies, which will be described in some detail later, indicates that boron is present in the feathery structures.

Figure 10:
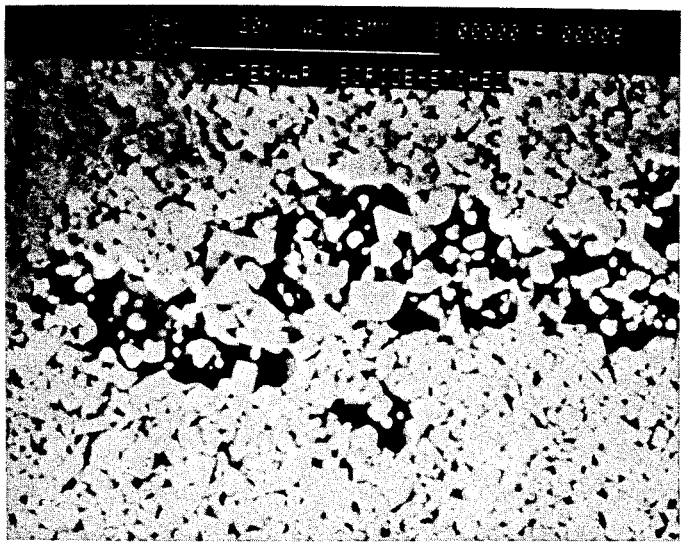
FIG. 10 is a photograph at a magnification of 2,040 times of a medium grain sample with 91% WC/9% Co which was sintered in sintering sand containing 1% by weight of boron nitride, the polished section of which has been treated with an acid etchant.
Figure 11:
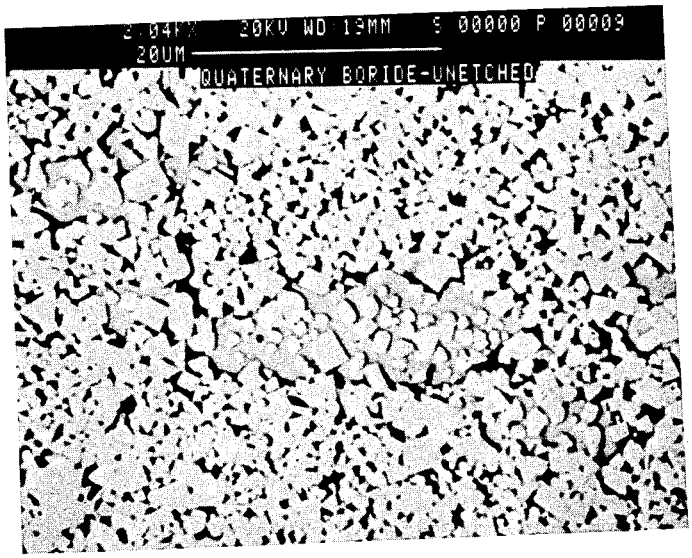
FIG. 11 is a photograph at a magnification of 2,040 times of a polished section of the sample of FIG. 10 without etching.

Third, the photos of FIGS. 10 and 11, which are at a higher magnification than the other photos, indicate that the swirls or feathers are actually a third phase, the average dimensions of which are larger than the average dimensions of the standard binder phase. This third phase fills up the spaces between tungsten carbide particles as a binder does. In FIG. 11, it can be seen that the tungsten carbide particles generally have straight sides and appear cubic, boxy, or angular. However, in the region of the third phase, the tungsten carbide particles are more rounded, and some have both shrunk in size and become rounded. It appears that the tungsten carbide particles are somehow reacting so that part of the material from the particles is lost from the particles and becomes part of the third phase An analysis of these samples indicates that, indeed, a substantial amount of tungsten is present in the third phase. Additionally, analysis shows that boron is present in this phase, as are carbon and cobalt.

Fourth, in some cases, as will be described below, the microstructure after etching shows white spots, the content of which is not known.

The present invention has been tested in several variations on several different carbide bodies. FIGS. 1–5 and 10–11 show the microstructures resulting from some of the tests.

In order to view the microstructure in FIGS. 1–5, the specimens are prepared in a standard manner. Typically, the specimen is mounted in a thermosetting epoxy resin. The sintered specimen is rough ground on a 220-mesh diamond-embedded wheel using water coolant. The specimen is then fine ground on a 45-micron diamond embedded wheel, using water coolant. Then the specimen is coarse polished on a hard-plane cloth wheel, such as nylon or silk, and then on a paper-based wheel. A charge of 15- or 30-micron diamond paste may be applied to the wheel for polishing. The wheel may be lubricated during polishing with oil or water or nothing, depending on the solubility of the diamond carrier. Then the specimen is ultrasonically cleaned in a soapy solution. Next, the specimen is medium polished on a hard-plane cloth wheel or a paper-based wheel as above except with a charge of 6- or 9-micron diamond paste, and then the specimen is ultrasonically cleaned in a soapy solution again. The specimen is then fine polished on a short-nap cloth wheel (such as rayon) or on a paper-based wheel. A charge of 1- or 3-micron diamond paste may be applied to the wheel for polishing, again using a lubricant, and then the specimen is ultrasonically cleaned in a soapy solution before processing. An additional polish may be done with a short-nap cloth charged with 0.25- to 1-micron diamond. Polishing is done until a scratch-free mirror-finish is obtained. Then, the sample is ultrasonically cleaned in a soapy solution, rinsed with water, rinsed with alcohol, and dried.

Then, to observe the feathery structure, an etchant is applied. Two chemical etchants have been found which reveal the structure. Murakami's Reagent, which is 10% KOH, 10% $K_3Fe(Cn)6$, and 80% $H_2O$ is applied, left on for two minutes, rinsed with water, then rinsed with alcohol and dried. Murakami's Reagent rapidly attacks the constituents of the carbides treated in accordance with the present invention, typically in two-to-four seconds. Alternatively, an acid etch prepared by mixing 30 ml $H_2O$ + 10 ml HCl + 10 ml $HNO_3$ is applied to the surface until a delayed foaming reaction is completed. Then the sample is rinsed first with water, then with alcohol, and then is dried. The acid etchant is generally less aggressive than Murakami's Reagent but provides more microstructural detail.

Another type of sample of the present invention has been prepared by mounting the specimen in a resin, highly polishing the specimen to a point at which it is a bit over-polished so that the harder elements are slightly raised above the softer elements, and placing a conductive material in the resin. This type of sample can then be analyzed using electron optics. A photograph of a sample prepared in this way and magnified approximately 2,000 times is shown in FIG. 11. Magnification of the polished, etched and unetched bodies by approximately 2,000 times in a scanning electron microscope as shown in FIGS. 10 and 11 reveals that the feathery structures are really a third phase, which appears to function as an additional binder phase. An analysis of this third phase will be described later.

As a general rule, the greater the amount of binder relative to carbide particles, the softer and tougher the material. However, in this case, what appears to be happening is that the additional phase serves to improve toughness without adversely affecting hardness.

The following examples describe in detail specific tests that were conducted.

EXAMPLE 1

One medium grain sample having 91% WC and 9% Co was sintered in a continuous stoking furnace in a disassociated ammonia atmosphere at 1450° C. for one hour while surrounded by an alumina sand heavily saturated in carbon and including 1% Boron Nitride. At high magnification (5,200x) a third, inventive phase was discovered, and the sample was analyzed.

The analysis was as follows:

| Phase | W | Co | C | B | O |
|---|---|---|---|---|---|
| Third Phase | 71 | 24 | 0.6 | 4.0 | — |
| Carbide Phase | 94.5 | 0.4 | 5(1) | — | — |
| Binder Phase | 14(2) | 85 | 0.8 | — | 0.3 |

(1)Underestimated.
(2)May be overestimated.

It is expected that this third phase will form with tungsten and cobalt reacting within a broad range of compositions, so long as there is sufficient carbon and boron present in acceptable ratios to permit formation of the third inventive phase. The third phase appears capable of existing within a range of compositions, with tungsten varying within a range of 50 to 95 weight percent; cobalt between 5 and 50 weight percent; carbon between 0.1 and 6.5 weight percent; and boron varying between 0.5 and 10.0 weight percent. It is expected that, within the third phase, the ratio of tungsten to cobalt by weight will always be greater than 1.0. It is also expected that the ratio of boron to carbon by weight in the third phase will always be greater than 1.0. an alumina sand heavily saturated in carbon and including 1% Boron Nitride. At high magnification (5,200x) a third, inventive phase was discovered, and the sample was analyzed.

The analysis was as follows:

| Phase | W | Co | C | B | O |
|---|---|---|---|---|---|
| Third Phase | 71 | 24 | 0.6 | 4.0 | — |
| Carbide Phase | 94.5 | 0.4 | 5(1) | — | — |
| Binder Phase | 14(2) | 85 | 0.8 | — | 0.3 |

(1)Underestimated.
(2)May be overestimated.

It is expected that this third phase will form with tungsten and cobalt reacting within a broad range of compositions, so long as there is sufficient carbon and boron present in acceptable ratios to permit formation of the third inventive phase. The third phase appears to be capable of formation within a range of compositions, with tungsten varying within a range of 60 to 95 weight percent and perhaps as much as from 50 to 95 weight percent; cobalt between 13 and 35 weight percent, perhaps as much as between 5 and 50 percent; carbon between 0.5 and 2.0 weight percent, perhaps as much as between 0.1 and 6.5 percent; and boron varying between 2.0 and 6.0 percent, perhaps as much as between 0.5 and 10.0 percent. It is expected that, within the third phase, the ratio of tungsten to cobalt by weight will always be greater than 1.0. It is also expected that the ratio of boron to carbon by weight in the third phase will always be greater than 1.0.

EXAMPLE 2

A sample of extra fine grain tungsten carbide (WC) powder was mixed in a ratio of 94.5% WC/5.5% Co, mixed with a lubricant, and pressed into a shape. The shape was surrounded with $Al_2O_3$ grains mixed with 2.5% BN powder by weight, placed in a graphite boat, and both pre-sintered and sintered in a continuous stoking furnace A sintering temperature of 1410° C. was maintained for about 70 minutes. During sintering, disassociated ammonia gas (nitrogen and hydrogen) flowed through the furnace.

The resulting microstructure (prepared and etched with the acid etch as described earlier) is shown in FIG. 2. When comparing the treated microstructure in FIG. 2 with the microstructure in FIG. 1, which was prepared in the same way except that no boron nitride was in the sintering sand, it will be noted that the sample which was treated with boron exhibits an unusual feathery or lacy etched constituent. The etched constituent is distributed fairly homogeneously throughout the sample. The tips of the feathers or branches appear darker and thicker than the rest of the etched constituent. Analyses which will be described later indicate that some form of boron is present in the feathery structure.

EXAMPLE 3

A sample of a medium grain WC powder was mixed in a ratio of 87% WC/13% Co, mixed with a lubricant, pressed into a shape, and, as in Example 2, sintered in a sand containing 2.5% by weight BN.

The sample was polished and etched with an acid etchant as described earlier, and its microstructure is shown in FIG. 4. Again, when comparing the microstructure of FIG. 4 with the microstructure of the same material sintered without BN, shown in FIG. 3, the microstructure of FIG. 4 exhibits the branching etched constituent Again, the tips of the branches are thicker and darker than the rest.

EXAMPLE 4

A medium grain sample of 87% WC/13% Co was prepared as in Example 1 except that 0.5% by weight of BN was added to the sand. Again, the branching effect is seen, and, upon greater magnification, white spots appear as indicated by the arrows.

The emphasis placed on this unusual microstructure is because it was the first way the invention was recognized and because it continues to be the easiest way to tell that the boron has indeed migrated into the body.

EXAMPLE 5

Vermont American's OM1 grade, which is a medium grain WC powder mixed with a Co binder powder in the ratio of 91% WC/9% Co was prepared and pressed with a lubricant into saw tips of the design of Vermont American's Model C-3110-1 tips. The tips were coated with a paint made of boron nitride (BN) mixed with water. The tips were dried under vacuum so that presumably only BN remained on the tips, were then placed on standard graphite trays provided for vacuum sintering, and were both pre-sintered and sintered under vacuum. The vacuum furnace was purged with an inert gas before sintering, and a vacuum was applied during the pre-sintering and sintering. The bodies were held at a sintering temperature of 1410° C. for sixty minutes, then cooled. The Rockwell hardness (A scale) of the samples was 90.7, and the coercive force Hc was 80.

The saw tips, when etched, again exhibited the fanning or feathering pattern described earlier throughout their microstructure.

EXAMPLE 6

The saw tip bodies were prepared as in Example 5 (91% WC/9% Co medium grain) except that the painted bodies were pre-sintered and sintered in a continuous stoking furnace. The coated samples were dried under vacuum, then surrounded by alumina ($Al_2O_3$) with no boron mixed in the sand and placed on graphite boats. A sintering temperature of 1410° C. was held for about 70 minutes, during which time disassociated ammonia flowed through the furnace.

At the same time that the painted or coated samples were sintered, uncoated samples were also sintered, and the test results were as follows:

| | Specific Gravity | Rockwell A | (Hc) |
|---|---|---|---|
| Untreated tips | 14.68 | 90.5 | 142 |
| Treated tips | 14.51 | 90.9 | 138 |

Again, the boron on the coated samples migrated throughout the samples, and the resulting samples exhibited the feathery-looking rapid etch phase described earlier throughout their structures, while the uncoated samples did not. The result is a homogeneous sintered body with no surface coating or layer. It will be noted that specific gravity, hardness, and coercive force showed no substantial change.

EXAMPLE 7

Saw tips which had originally been sintered without boron in Vermont American's Style C-3170-1 from 91% WC powder medium grain mixed with 9% Co powder were resintered in a continuous stoking furnace in a graphite boat surrounded by alumina sand mixed with 0.5% by weight BN powder. The sintering time and temperature and gas flows were as in Example 2. Again, the distinctive feathering microstructure appeared.

The resulting saw tips were brazed onto 10", 40 tooth saw blades The brazed joint strength was tested with a drop weight impact test and compared with brazed joints utilizing standard WC tips. The drop-weight impact test results for the boron-treated tips were 166 inch-ounces versus 136 inch-ounces for the regular WC tips, an improvement of 22%.

These blades were used to cut ¾" medium density particle board, and power consumption measurements were recorded after every 50 lineal feet cut. These blades were tested against blades which were identical except their tips were either (1) untreated or (2) treated by the "Borofuse" process, which is thought to deposit a boride layer on the surface. The test results are shown in a graph in FIG. 6, which shows a clear improvement of the blade with tips made according to the present invention over the other two blades. The blade of the present invention required considerably less consumption of power than the other blades at all stages of the test. The power consumption is directly related to the edge sharpness, so these tests indicate that the blades of the present invention had better initial edge sharpness and better edge retention than the others.

EXAMPLE 8

WC/Co bodies were sintered in alumina sand in a continuous stoking furnace with a sintering temperature of 1410° C. maintained for about 70 minutes. Samples were made up of various WC/Co grades from micrograin size with 6% Co to medium grain with 13% Co to extra-coarse grade with 6.5% Co. The amount of BN in the alumina sand varied from 0% to 2.5% at 0.5% increments for each sample. The specific gravity, Rockwell hardness, transverse rupture strength, coercive force, shrink factor and percent weight loss were tested for each sample, and the test results showed that the amount of boron nitride in the sand did not affect those properties to a degree greater than the variation in normal manufacturing. The characteristic feathery constituent appeared in the microstructure of each sample in which BN was present in the sand.

EXAMPLE 9

Carbide test plugs having the dimensions of 0.2 inches×0.25 inches×0.75 inches were sintered from a medium grain powder of 91% WC/9% Co in alumina sand without any boron present. Subsequently, these test plugs were re-sintered in alumina sand mixed with different types of boron containing powder in a continuous stoking tube furnace at 1410° C. for about 70 minutes in an atmosphere of disassociated ammonia. In each case, the microstructure showed the same distinct etching pattern indicating the diffusion of boron into the carbide structure. The boron sources, hardness (RWA), and coercive force (HC) results are shown below:

| Type of Boron Source | Amount in sand (Wt. %) | RWA | HC |
|---|---|---|---|
| boron carbide | .1 | 90.3 | 156 |
| boron powder | .1 | 90.5 | 162 |
| boron oxide | .5 | 90.8 | 158 |
| boron oxide | 1.0 | 90.7 | 157 |

EXAMPLE 10

A. A number of multicarbide grades were also tested. Metal cutting saw tips of Vermont American style 170H280, grade MC115 which has a medium grain size and is made up of 77.1% WC, 11.4% Co, 4% TiC, 5.25% TaC, 2.25% NbC were resintered in alumina sand with 1.0% BN. The characteristic microstructure is again present, indicating that boron has diffused throughout the structure.

B. The same style tips of grade MC85, which is a medium grain made up of 72.0% WC, 8.5% Co, 8% TiC, 11.5% TaC were also resintered in sand containing 1.0% BN, and the characteristic feathery microstructure appeared again.

It is expected that other carbide formers could be used, such as, the IVB, VB and VIB elements, for example: titanium, zirconium, hafnium, vanadium, niobium, tantalum, chromium, molybdenum, and tungsten, and combinations thereof. Binder metals might be manganese, iron, cobalt, nickel, copper, aluminum, silicon, ruthenium, osmium used alone, in combination with each other, or in combination with each other and with any of the IVB, VB and VIB elements listed earlier as carbide formers.

EXAMPLE 11

Below is a table showing the impact of varying percentages of boron-nitride material added to the alumina sintering sand on the corrosion resistance of the bodies.

All of the samples analyzed in this table were prepared from 91% WC/9% Co powders of medium grade and all were sintered in graphite boats surrounded by $Al_2O_3$ sintering sand doped with different amounts of boron-containing material (BN) under the same conditions (disassociated ammonia atmosphere with sintering temperature of 1410° C. for about 1 hour); the only difference in their treatment was the percent by weight of boron-containing material (BN) added to the $Al_2O_3$ sintering sand.

To test for corrosion resistance, each sample was weighed, placed in HCl for 24 hours at room temperature, then weighed again to determine the percent weight loss due to corrosion. The smallest amount of corrosion occurred with a BN doping of 0.9%.

| BN/Sintering Media Ratio | % Weight Loss |
|---|---|
| | 00.057 |
| .1 | 00.113 |
| .5 | 00.056 |
| .9 | 00.012 |
| 2.0 | 00.0215 |
| 25.0 | 00.0357 |
| 50.0 | 00.0494 |
| 75.0 | 00.0580 |
| 100.0 | 00.0781 |

Additional tests were conducted to see how much or how little BN was needed on the sand in order to obtain the feathery microstructures, and it was found that the present invention is successful in incorporating boron into the bulk chemistry of a WC/Co carbide body with as little as 0.006% BN added to the sintering sand and with as much as a total replacement of the sintering sand with BN. The practical working range of the present invention for WC/Co carbide bodies appears to be to utilize between 0.1 and 5.5% of boron-nitride material in the sintering sand. Optimum corrosion resistance was achieved with a BN doping of about 0.9% in the alumina sand. It will be seen from other tests described below that other optimum characteristics seem to occur with about the same amount of doping.

EXAMPLE 12

Fracture toughness and Eddy Current tests were conducted on various types of samples made in accordance with the present invention. The first group of samples was made with Vermont American's grade 2M12, a coarse grain 89.5% WC/ 10.5% Co. Varying amounts of boron nitride were mixed in the alumina. The second group of samples was made with Vermont American's grade OM2, a fine grain 94% WC/ 6% Co. Varying amounts of boron nitride were mixed in the alumina sand. The sintering was done in a disassociated ammonia atmosphere in a continuous stoking furnace with the sintering temperature of 1410° C. held for about 70 minutes.

A bulk analysis is shown in the table below.

| % by Weight BN in the sand | ppm Boron for OM2 samples | ppm Boron for 2M12 samples |
|---|---|---|
| 0.5 | 336.6 ± 2.4 | 377.5 ± 2.6 |
| 1.0 | 383.4 ± 3.1 | 408.9 ± 2.9 |
| 1.5 | 376.3 ± 2.3 | 537.4 ± 3.8 |
| 2.0 | 543.0 ± 3.8 | 806.9 ± 4.8 |
| 2.5 | 501.4 ± 4.0 | 730.8 ± 3.6 |

In order to measure fracture toughness, the samples were made up in short cylindrical rods of 0.5 inch diameter and 0.750 inch height, and a cut was then made into the rod in accordance with the procedure set out in *International Journal of Fracture,* Vol. 15, No. 6, Dec. 1979, pp. 515–536, which is hereby incorporated by reference.

Figure 6:
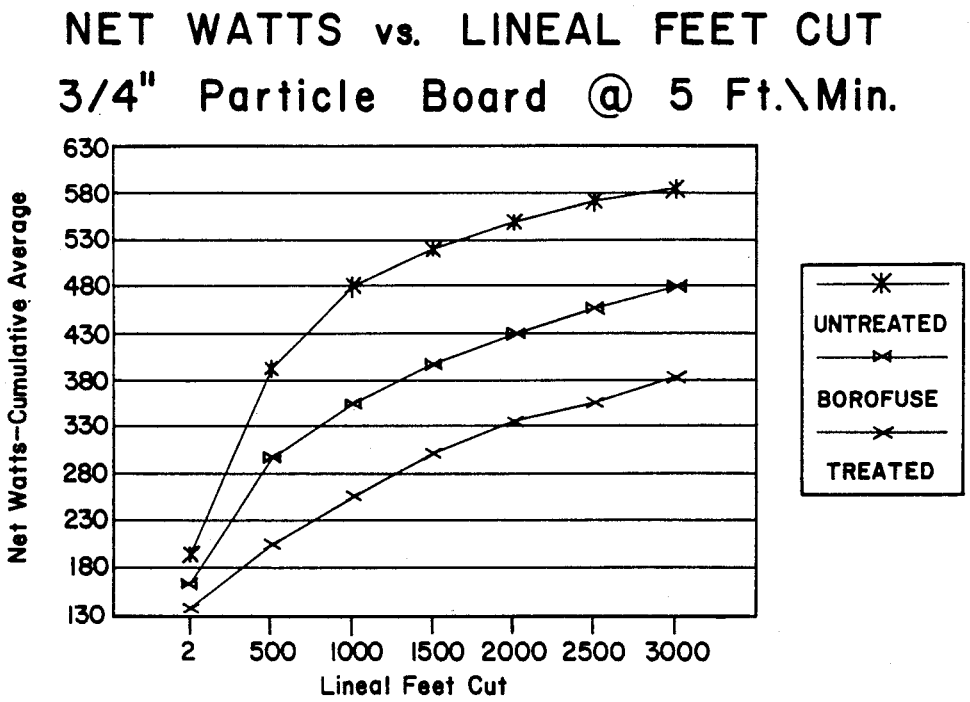
FIG. 6 is a plot of net watts versus lineal feet cut for saw blades cutting 0.75 inch thick medium density particle board at 5 feet per minute for untreated blades, blades with Borofuse processed tips, and blades with tips treated in accordance with the present invention.

FIG. 6 shows a plot of apparent fracture toughness (Ka) versus percentage by weight of boron nitride in the alumina sand. The apparent Fracture Toughness (Ka) shows significant improvement for each alloy upon the addition of BN to the sand. It appears that percent by weight of BN in the sand of between 0.5 and 2 gives optimum fracture toughness This translates to an amount of boron in the sand of 0.2 to 0.9 percent by weight.

Figure 7:
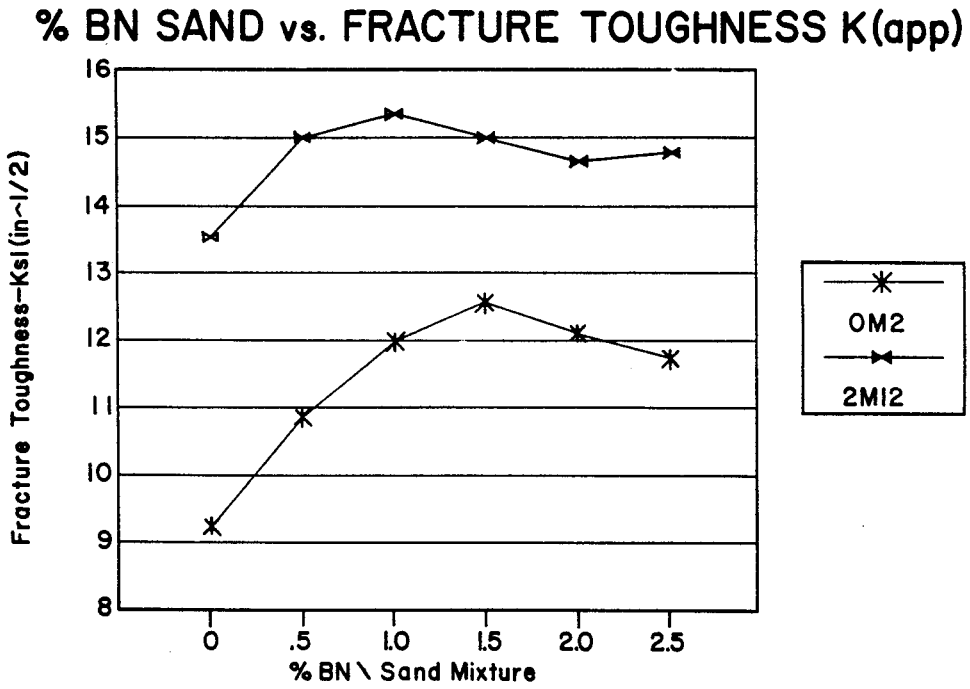
FIG. 7 is a plot of apparent fracture toughness (Ka) versus %BN in the sintering sand for two grades of material.
Figure 8:
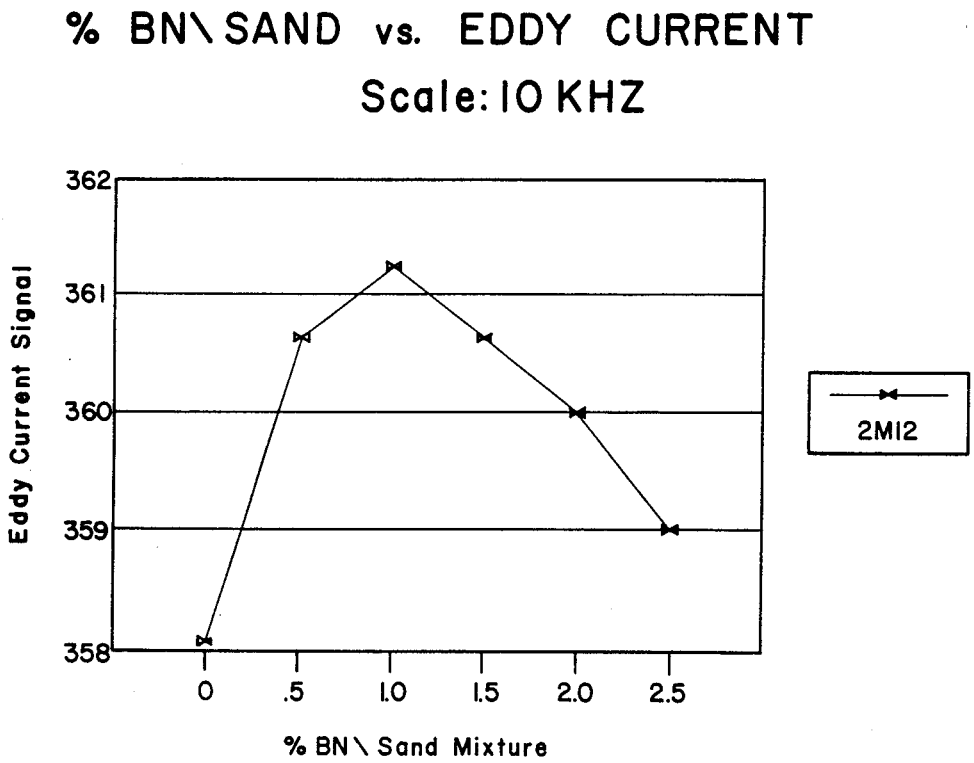
FIG. 8 is a plot of the eddy current signal versus %BN in the sintering sand for Vermont American's 2M12 grade samples.
Figure 9:
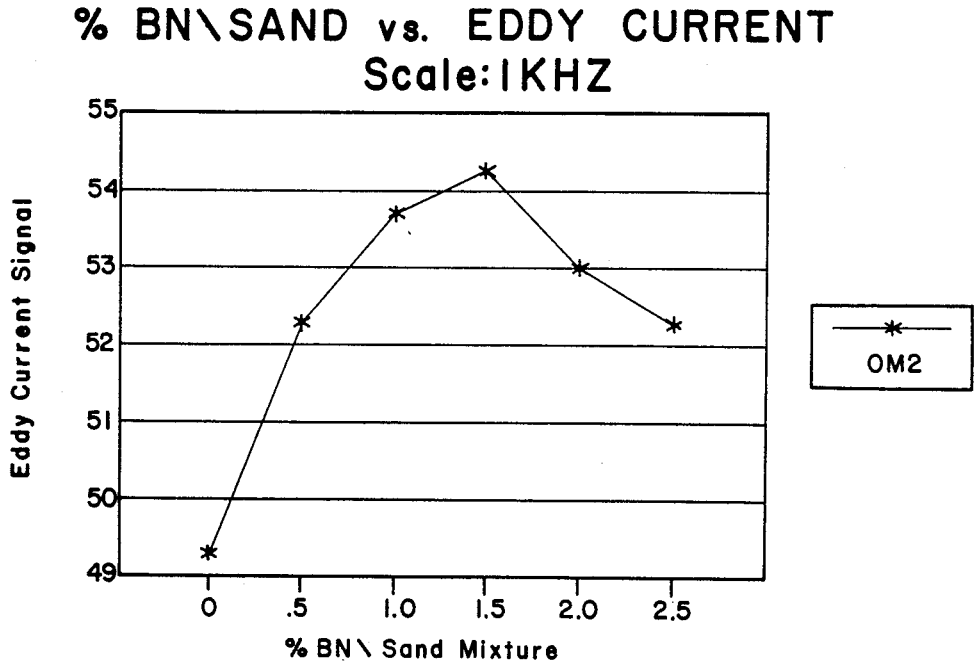
FIG. 9 is a plot of the eddy current signal versus %BN in the sand for Vermont American's OM2 grade samples.

FIGS. 7 and 8 are plots of Eddy current results for the same samples The peak for the OM2 grade is at 1.5% BN in the sand for both fracture toughness and Eddy Current, and the 2M12 grade peaks at 1.0%BN in the sand for both tests. These appear to be the optimum BN dopings.

Additional analysis of these samples indicates that the concentration of Boron in these samples is greater toward the outside and gradually reduces to a lower concentration toward the center. It has been demonstrated that a post treatment diffusion process at elevated temperatures of 1410° C. for about 70 minutes will produce a more uniform distribution of the etch pattern in large samples in which a change in boron concentration from surface to core has been observed. When this was done, the morphology of the third phase changed from feathery to rounded clusters, so it is possible for the boron to be distributed throughout the body without the presence of a feathery etch phase.

Another analysis of these samples was done for the distribution of boron in the samples and found that the boron is distributed in a fern-type pattern which is virtually identical to the pattern shown in the treated metal when etched with acid or Murakami's reagent Because the distribution of boron is in the same pattern displayed by the acid etch of the treated metal sample described earlier, the conclusion is drawn that boron is present in the fern-type pattern that is revealed when the treated metal samples are etched.

EXAMPLE 13

A test was Conducted with commercial sawmill blades in which a standard WC/Co tipped blade was tested against the identical blade in which fine grain tips of 94% WC/6% Co, already-sintered under the standard process, were re-sintered in a continuous stoking furnace in alumina sand mixed with 1% BN by weight. The standard blade lasted 40 hours. The blade with re-sintered tips treated according to the present invention lasted 462 hours and was still cutting well when it was removed for evaluation.

EXAMPLE 14

A test was conducted with carbide-tipped circular saw blades, comparing the standard 94% WC/6% Co fine grain tips to identical tips re-sintered in 1% BN mixed in the alumina sand. Both blades were cutting copper tubing. The standard blade made 5,408 cuts, and the treated blade made 22,743 cuts. The treated blade was then resharpened and made 16,000 more cuts.

EXAMPLE 15

This test was done to compare the treated and non-treated carbide tips in cutting fiberglass. The tips were made of fine grain 95.5% WC/4.5% Co, and some tips were treated by re-sintering in alumina sand with 1% BN added. The tips were put on hole saws. The regular untreated carbide tipped hole saws cut 16–18 fiberglass panels. The hole saw with treated tips cut 24 fiberglass panels.

EXAMPLE 16

A test was run to see what would happen if unsintered carbide bodies were sintered in pure boron powder. Saw tips were placed on trays in a vacuum furnace. Argon gas was present at the full sinter temperature and disassociated ammonia was present at intermediate temperatures. The green (unsintered) body was surrounded by boron powder and sintered. The result was a deformed plug with a surface layer. Thus, sintering in 100% boron powder does not achieve the present invention.

However, other carbide bodies which were in the same furnace during this test, were not surrounded by the boron powder and were remote from it, and some of these remote bodies showed the feathery microstructure, indicating that boron had entered into their microstructure. This indicates that the boron entered the body in a gas phase and raises the possibility that the desired homogeneous boron dispersion in the body could be accomplished by passing some type of boron-containing gas through the furnace during sintering. It is thought that the boron could be supplied by boron-containing inorganic or organometallic compounds having vaporization temperatures convenient for the introduction of their vapors or of gaseous, boron-containing breakdown species into the treatment zone.

EXAMPLE 17

Tests were conducted to see whether the atmosphere in the sintering furnace affected the amount of boron in the sample. In these tests, the samples were OM1 grade containing 91% WC and 9% Co. They were sintered in a continuous stoking furnace in a sand containing 1% BN, and were sintered at 1400° C. or one hour. After sintering, a bulk analysis was done to determine the amount of boron in the sample. It was found that an ammonia atmosphere permitted much more boron to enter the microstructure than did a nitrogen atmosphere and that a pure hydrogen atmosphere permitted even more boron to enter the microstructure. In the case of an atmosphere of $N_2$ or dry $N_2$, the sintered sample contained about 30 parts per million (ppm) of boron. In the $NH_3$ atmosphere, the sample contained about 430 ppm boron, and the dry $NH_3$ atmosphere produced a sample having 365 ppm boron. The pure dry hydrogen produced a sample having 1376 ppm boron.

It will be obvious to those skilled in the art that modifications may be made to the embodiments described above without departing from the scope of the present invention.

What is claimed is:

1. A cemented carbide body, comprising:
a tungsten carbide phase;
a cobalt binder phase; and
a third phase comprising cobalt, tungsten, boron, and carbon.

2. A cemented carbide body as recited in claim 1, wherein the ratio by weight of tungsten to cobalt in the third phase is greater than 1.0.

3. A cemented carbide body as recited in claim 2, wherein the ratio by weight of boron to carbon in the third phase is greater than 1.0

4. A cemented carbide body as recited in claim 3, wherein the ratio by weight of boron to carbon in the third phase is between 1.0 and 12.0.

5. A cemented carbide body as recited in claim 1, wherein the tungsten carbide particles are generally angular and blocky in shape but, in the region of the third phase, the tungsten carbide particles are rounded and smaller.

6. A cemented carbide body as recited in claim 1, wherein the average dimensions of the third phase are larger than the average dimensions of the cobalt binder phase.

7. A cemented carbide body, comprising:
(a) a carbide phase, including a carbide former and carbon;
(b) a binder phase made mostly of a binder element; and
(c) a dispersion of boron-containing material throughout the body, wherein the microstructure of said carbide body, when etched with Murakami's Reagent, exhibits an etch phase throughout the body.

8. A cemented carbide body as recited in claim 7, wherein:
(a) the carbide former is a member of the group: titanium, zirconium, hafnium, vanadium, niobium, tantalum, chromium, molybdenum, and tungsten;
(b) the binder phase is from the group: manganese, iron, cobalt, nickel, copper, aluminum, silicon, ruthenium, and osmium; and
(c) the amount of boron in the body is between 25 and 3000 parts per million.

9. A cemented carbide body as recited in claim 7, wherein the carbide phase is WC and the binder phase is Cobalt.

10. A cemented carbide body as recited in claim 1 or 7, wherein the amount of boron in the body is between 25 and 3000 parts per million.

11. A cemented carbide body as recited in claim 7 or 9, wherein the distribution of the amount of boron in the body is a controlled gradient, with greater concentrations of boron and the etch phase at the surface and lesser concentrations towards the center of said body.

12. A cemented carbide body as recited in claim 7, wherein said etch phase also includes a greater percent by weight of the carbide former than is found in the binder phase.

13. A cemented carbide body, comprising:
(a) a carbide phase;
(b) a binder phase having less than 30 percent by weight of carbide former; and
(c) a third phase including a binder material and boron.

14. A cemented carbide body as recited in claim 13, wherein said third phase also includes at least 40% by weight of carbide former.

15. A cemented carbide body as recited in claim 13, wherein the carbide former is tungsten and said third phase includes approximately 60% by weight of tungsten.

16. A cemented carbide body as recited in claim 7, wherein said etch phase, before being etched, includes some of the carbide former, some of the binder element, some carbon, and some boron, and wherein the ratio by weight of carbide former to binder element in the etch phase is greater than 1.0.

* * * * *

UNITED STATES PATENT AND TRADEMARK OFFICE

CERTIFICATE OF CORRECTION

PATENT NO. : 4,961,780

DATED : October 9, 1990

INVENTOR(S) : Donald C. Pennington, Jr.

It is certified that error appears in the above-identified patent and that said Letters Patent is hereby corrected as shown below:

Sheet 1 of 9, Fig. 1, figure as printed does not accurately reflect the original figure submitted. White streak down center of figure is not part of photomicrograph.

Column 4, line 39, after "coating" and before "Moderately successful" insert -.-;

Column 5, line 61, after "part of the third phase" and before "An analysis" insert --.--;

Column 7, line 37, delete beginning with "an alumina sand ..." through end of column 7, line 68;

Column 8, line 9, after "furnace" and before "A sintering temperature" insert --.--;

Column 8, line 38, after "constitutent" and before "Again, the tips" insert --.--;

Column 11, line 17, insert --%-- before "BN/Sintering Media Ratio";

Column 11, line 18, insert --0-- in first column opposite "00.057";

Column 12, line 16, after "same samples" and before "The peak for" insert--.--;

Column 12, line 38, after "Murakami's reagent" and before "Because"insert--.--;

Column 13, line 46, delete "or" and insert therefore --for--.

Signed and Sealed this

Seventeenth Day of March, 1992

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,961,780

DATED : October 9, 1990

INVENTOR(S) : Donald C. Pennington, Jr.

It is certified that error appears in the above-identified patent and that said Letters Patent is hereby corrected as shown below:

On the title page item [56] References Cited Column 1, after "References Cited" under "U.S. Patent Documents," please insert:

| | | | |
|---|---|---|---|
| -- | 4,837,089 | 6/89 | Arak, et al -- |
| -- | 4,268,582 | 5/81 | Hale, et al -- |
| -- | 4,693,746 | 9/87 | Nakai, et al -- |
| -- | 4,442,180 | 4/84 | Hara, et al -- |

Signed and Sealed this

Fifth Day of May, 1992

*Attest:*

DOUGLAS B. COMER

*Attesting Officer*

*Acting Commissioner of Patents and Trademarks*